US005470048A

United States Patent [19]

Taira et al.

[11] Patent Number: 5,470,048

[45] Date of Patent: Nov. 28, 1995

[54] SLIDING NOZZLE PLATE-METAL FRAME FIXING STRUCTURE

[75] Inventors: Toshimitsu Taira; Masao Ohnuma; Hisao Hanada; Teruo Aoki; Tetsuro Kuhara, all of Fukuoka, Japan

[73] Assignee: Krosaki Corporation, Fukubka, Japan

[21] Appl. No.: 298,441

[22] Filed: Aug. 29, 1994

[51] Int. Cl.[6] ..... B22D 41/22

[52] U.S. Cl. ..... 266/236; 222/600

[58] Field of Search ..... 266/236; 222/600, 222/597, 590, 591

[56] References Cited

U.S. PATENT DOCUMENTS 5,174,908 12/1992 King et al. ..... 222/600
5,211,857 5/1993 Brinker ..... 222/600

FOREIGN PATENT DOCUMENTS 2040423 8/1980 United Kingdom ..... 222/600

*Primary Examiner*—Scott Kastler
*Attorney, Agent, or Firm*—Jordan and Hamburg

[57] ABSTRACT

A sliding nozzle plate-metal frame fixing structure which allows the sliding nozzle plate to be mounted to and removed from the metal frame with ease. The sliding nozzle plate which is used with a sliding nozzle device attached to a molten metal vessel has a sliding surface, and is surrounded by a metal case with the exception of the sliding surface. The metal case has a projection or a plurality of projections of a particular shape on the surface of the plate opposite the sliding surface, and a metal frame in which the metal-cased plate to be mounted has a plurality of concave portions corresponding to the projection or projections of the metal case, so that the metal-cased plate can be mounted to and removed from the metal frame simply and accurately through engagement and disengagement of each of the metal case projection or projections with each of the metal frame concave portions.

3 Claims, 4 Drawing Sheets

SLIDING NOZZLE PLATE-METAL FRAME FIXING STRUCTURE

BACKGROUND OF THE INVENTION

1. Field of the Invention

The present invention relates to a structure in which a metal-cased plate such as a plate-like refractory material to be used for a sliding nozzle device attached to a molten metal vessel is fixed to a metal frame. The term plate used herein covers the upper and lower plates of a double plate unit or the upper and lower plates of a triple plate unit.

2. Description of Prior Art

Regarding a plate-like refractory material to be used for a sliding nozzle device, a metal-cased plate is known to be disclosed in Japanese Unexamined Patent Publication No. 48-6932. A number of proposals have so far been made as to how to fix a plate-like refractory material to a metal frame as can be seen in Japanese Unexamined Utility Model Publications Nos. 49-119422 and 52-115607 and Japanese Unexamined Patent Publication No. 60-234765.

In Japanese Unexamined Patent Publication No. 1-218761, there has been proposed a sliding plate positioning method based on the outside of a metal case being concentric with the nozzle hole of a sliding nozzle device so that the attachment of the sliding plate to a sliding metal frame is simplified. However, this proposal has the disadvantage that since the outer side of the metal case for positioning lies around the molten metal passage hole, if the outside dimensions of the metal case become large and the temperature difference between the metal case and the sliding metal frame becomes too large in cooling process, the clearance between the metal case and the sliding metal frame will tend to decrease. Further, the metal case has been known to get caught deep into the metal frame and the sliding plate sometimes becomes stuck resulting in a hindered exchanging operation of the sliding plate.

SUMMARY OF THE INVENTION

Accordingly, an object of the present invention is to provide a structure in which a stationary plate or a sliding plate having a non-sliding surface is easily mounted on, or dismounted from, a metal frame.

Another object of the present invention is to provide a structure in which the above-mentioned plate can be replaced in a stabilized manner even when the temperature of the plate is still high after pouring.

Still another object of the present invention is to manufacture the above-mentioned plate in a simple manner.

As means for achieving the above-mentioned objects, according to the present invention, the metal-cased plate has a projection or a plurality of projections on the surface opposite its sliding surface. Each of the projections is made to have a shape that provides a fitting clearance in the range of between 0.1 and 1.0 mm between the projection and the metal frame in the sliding direction of the plate when the projection is fit in the metal frame. Furthermore, each projection's cylindrical portion has a diameter of less than one-third of the width of the plate and a height of 1–5 mm and the projection's bowl-like portion is continuous with the cylindrical portion.

In operation, the plate is synchronized with the movement of the metal frame and, to simplify the plate exchanging operation, the projections formed on the metal case are made to rest on the surface opposite the sliding surface of the plate with the outer shape of each of the projections being made to form a fitting clearance in the range of between 0.1 and 1.0 mm from the metal frame. Plural (as opposed to single) projections are preferable for preventing the turning of the plate.

Further, in order that the clearance between the projections of the plate and the metal frame in cold condition may not be affected by a heat load during pouring, the outer diameter of each projection is made less than one-third of the width of the plate. Moreover, a temperature difference commonly takes place between the projection of the plate and the plate fitting portion of the metal frame due to the heat load at the time of pouring. That is, the plate side temperature becomes 20–100 K higher than the metal frame side temperature so that the clearance between the plate and the metal frame in the plate sliding direction decreases. Thus, by reducing the outer diameter of the projection to one-third the width of the plate, it is possible to reduce the differences in clearance between the cold and hot condition. This prevents the projections from becoming unsynchronous to the sliding metal frame due to the clearance becoming too large, or becoming stuck to the sliding metal frame due to the clearance becoming too small.

To simplify the mounting and dismounting of the plate to and from the metal frame, each of the projections has a cylindrical portion of a height of 1–5 mm and a bowl-like portion continuous with the cylindrical portion. If the height of the cylindrical portion, i.e., the fitting portion, of the projection is less than 1 mm, a defective fitting takes place, while when it is more than 5 mm, the mounting and dismounting of the plate with respect to the metal frame must be done in a manner in which a drawer is pulled out so that the plate is not handled favorably. Further, not only a shearing force but also a bending force is applied on the projection of the plate at the time of the sliding operation, thus reducing the strength of the projection. When the plate is being fitted to the metal frame, the bowl-like portion of the projection continuous with the cylindrical portion serves as a guide. Further, by the formation of the bowl-like portion instead of leaving that portion simply cylindrical, the strength of the projection is increased and the movement of the metal frame is securely transmitted to the plate.

To simplify the mounting and dismounting operations of the plate with respect to the metal frame, according to the present invention, a high-precision fitting is employed only in the sliding direction when an important positioning operation is performed at the time of pouring, and a considerable amount of play is provided in a direction normal to the sliding direction. Thus, by the allowance of such play, the dismounting of the plate is simplified.

To simplify the manufacturing process of the plate according to the present invention, the projections of the metal case are made to rest on the surface opposite the sliding surface of the plate, the height of the cylindrical portion of each of the projections is made to be less than 5 mm and the portion continuous with the cylindrical portion is made to be bowl-like. These metal case projections are made to fit in the concave portions of the metal frame. It is also possible to form like projections on the metal frame and to form like concave portions on the metal case, but such an arrangement will cause a problem in placing the plate-like refractory material in the metal case. When concave portions are formed on the metal case, the thickness of the joint material for connecting the metal case and the refractory material must cover the height of each concave portion. This would make the overall thickness of the material excessively large. Further, there is also a method of forming concave portions on the refractory material itself but this method is not favorable because the refractory material tends to crack.

As for metal case manufacturing methods, there have been considered welding, forging, pressing, cutting, or combinations of these, but simple press working is easy and efficient. Where press working is performed, a press mold is required and in this case, it is important to avoid making a mold of unsuitable shape. A suitably shaped mold will have an extended working life which will provide a reduction in costs. According to the present invention, each of the projections of the metal case is made to have a cylindrical portion of a height of less than 5 mm in the pressing direction and a bowl-like portion having a curvature continuous with the cylindrical portion.

BRIEF DESCRIPTION OF THE DRAWINGS

FIG. 4 is a view of the essential portion of the sliding nozzle plate of FIG. 2 especially when taken from a plane normal to the sliding direction in which FIG. 3 is taken;

PREFERRED EMBODIMENTS OF THE INVENTION

Figure 1:
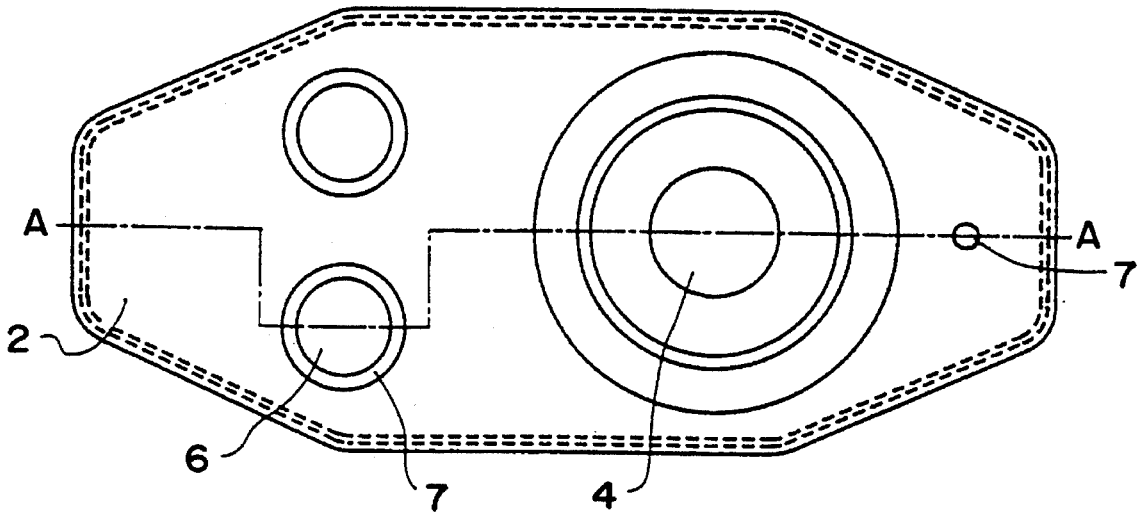
FIG. 1 is a plan view of a sliding nozzle plate according to one embodiment of the present invention.
Figure 2:
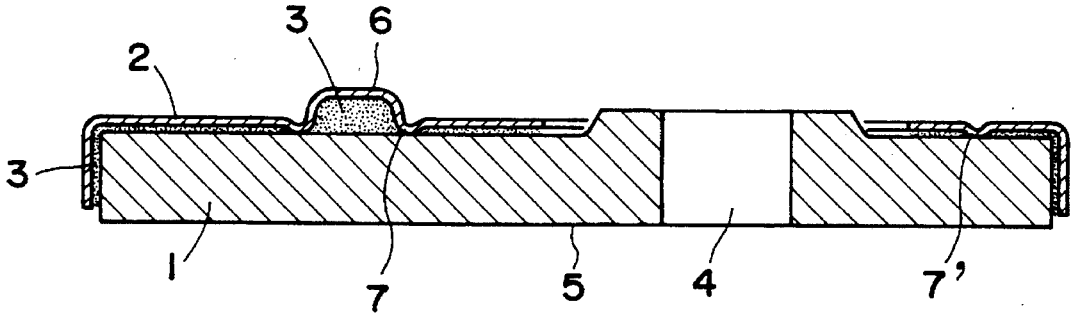
FIG. 2 is a vertical sectional view taken along the A—A line of FIG. 1.

FIGS. 1 and 2 show a first embodiment of the present invention which is an example of an application of the present invention to an upper (stationary) plate of a double plate type sliding nozzle device. In these figures, reference numeral 1 designates a plate-like refractory material and reference numeral 2 designates a metal case enveloping the plate-like refractory material with the exception of a sliding surface 5 of the latter. Between plate-like refractory material 1 and metal case 2 there is filled a refractory mortar 3. Reference numeral 4 designates a molten metal passage hole which adjusts the flow rate of a molten metal by mutual sliding motions of two sliding plates in cooperation with the sliding surface 5. Reference numeral 6 designates a projection for positioning the plate-like refractory material 1 with respect to a metal frame, and the projection includes a portion in the shape of a bugle with a return section which is continuous with the cylindrical portion so as to form a gently curved surface smoothly approaching a horizontal bottom surface of the metal case, with the height of the return section 7 being identical to the thickness of a joint material to be filled between the refractory material and the metal case. Reference numeral 7', as well as reference numeral 7, designates a bent projection for maintaining a constant thickness of mortar bonding.

For the plate-like refractory material 1, alumina, zircornia, zircon, alumina carbon, magnesia and the like materials are used. The practical thickness of the metal case 2 is in the order of 1–6 mm and in the instant embodiment, and metal case 2 is manufactured by press-molding a 3.2 mm carbon steel plate. The curvature radius of the bent portion is kept in the range of at least 3–8 mm so as to reduce the consumption of the press mold. In the instant embodiment, the plate-like refractory material 1 is press-fitted into the metal case 2 after putting mortar therein and then dried to thereby obtain a plate. Further, a total of about ten (10) small holes (not shown) are drilled in the metal case for the purpose of ventilation at the time of press-fitting of the plate-like refractory material and to accelerate of drying.

Figure 3:
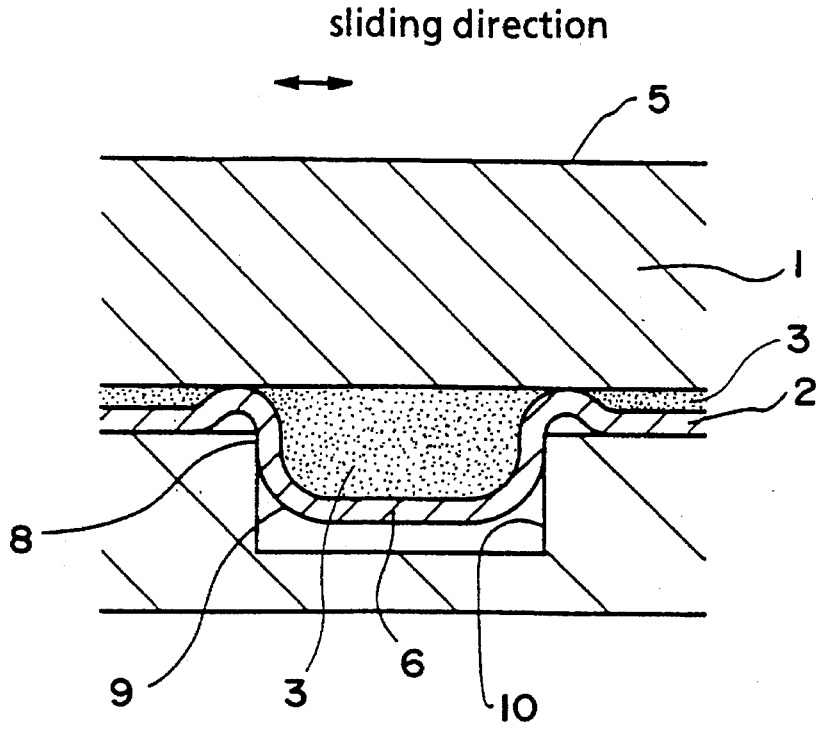
FIG. 3 is an enlarged view of an essential portion of the sliding nozzle plate shown in FIG. 2.

FIG. 3 is an enlarged sectional view of an engaging section between the projection of the plate and a concave section of the metal frame according to the present invention, taken in the sliding direction of the plate.

Figure 4:
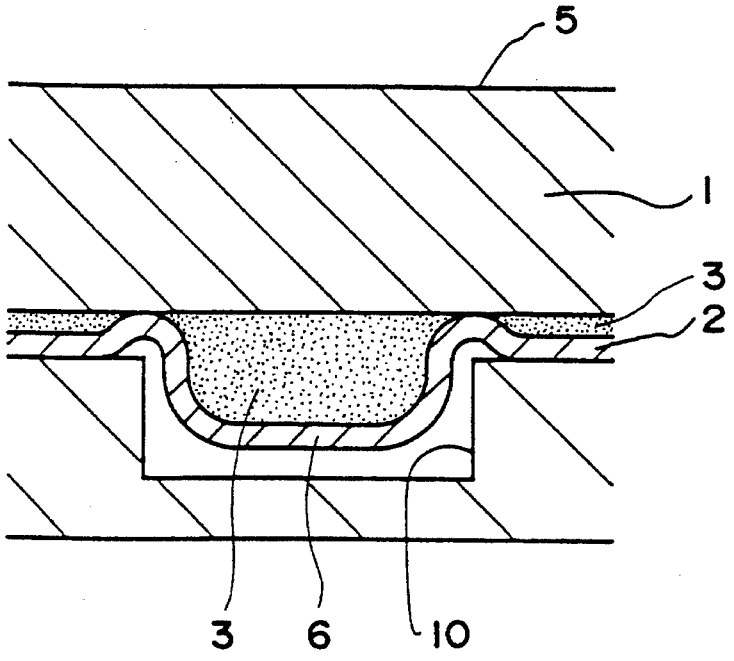

FIG. 4 is a sectional view of the portion of FIG. 3 taken from a direction normal to the sliding direction of the plate. The shape of each projection 6 is simply circular and the external shape of its cylindrical portion 8 is specifically finished to a high level of accuracy, i.e., ±0.2 mm, and with diameter of the circle being 36 mm, which is less than one-third the width (200 mm) of the plate. The projections 6 (which are two in number) are formed on the surface opposite the sliding surface of the plate. These projections are subject to the sliding force of the metal frame and at the same time, prevent the plate from rotating in a horizontal plane.

Where the plate 1 is mounted to the metal frame, due to a rough-positioning thrusting operation by an operator of an automatic mounting machine, a bowl-like portion 9 continuous with the cylindrical portion 8 of the projection 6 abuts against the edge of a concave portion 10 along the bowl-like portion 9 acting as a guide. The projection 6, thus slid, is substantially fixed due to the high-precision engagement between the cylindrical portion 8 and the concave portion 10. To secure the correct fitting of the projection 6 into the concave portion 10, the projection 6 is made to have a height of 5–15 mm. Where there is the possibility that the mere engagement of the plate 1 with the concave portion 10 can disengage the plate from the latter when the thrusting operation is released, the plate is temporarily fixed by stop spring means or magnet means (not shown) so that the mounting of the plate can be performed quite simply.

Next is described how the plate 1 is dismounted from the metal frame. When the above-mentioned high-precision engagement between the cylindrical portion 8 of the plate 1 and the concave portion 10 of the metal frame is secured in every direction, the cylindrical portion 8 can not allowed to move except in a drawer-like manner when it is taken out and therefore, a play of 1–10 mm is provided between the two in a direction normal to the sliding direction of the plate 1 so that the plate may be forced up to thereby remove the plate from the metal frame.

Figure 5:
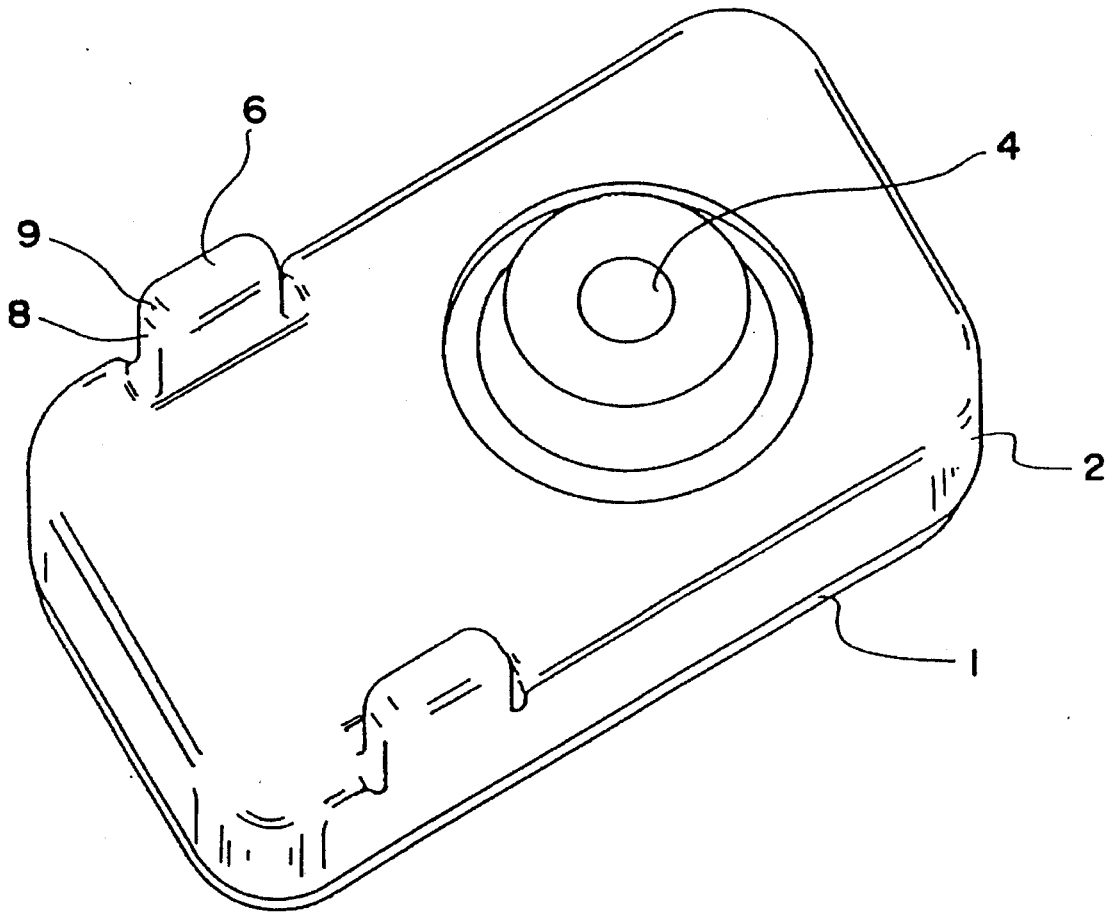
FIG. 5 is a perspective view of a sliding nozzle plate according to a second embodiment of the present invention.

FIG. 5 shows a second embodiment of the present invention wherein the projections of the metal case are formed at the corners of the plate 1. The fitting-clearance between the box-shaped projection 6 and the concave portion of the metal frame (not shown) in the sliding direction is 0.3 mm. The clearance therebetween in a direction normal to the sliding direction is 4 mm.

The length of the projection in the sliding direction is set to 60 mm, which is less than one-third the width (210 mm) of the plate. The width of the projection is set to 20 mm. The projection has a planar portion 8 of 3 mm in height on a plane intersecting the plate sliding direction. This planar portion is subject to a sliding force from the metal frame as in the case of the outer shape of the cylindrical portion of the first embodiment. A curved portion 9 continuous with the planar portion serves as a fitting guide as does the bowl-like portion of the first embodiment.

Thus, the shape of the projection of the present invention may not always be circular.

Figure 6:
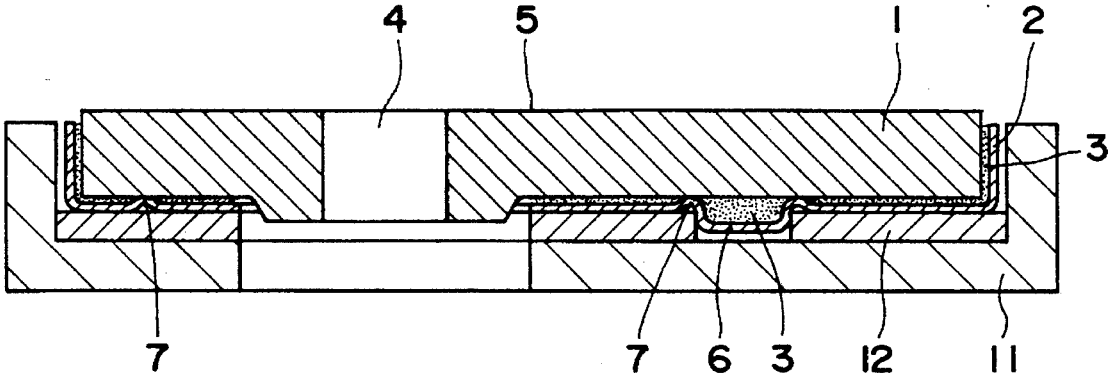
FIG. 6 is a vertical sectional view of a sliding nozzle plate according to a third embodiment of the present invention.
Figure 7:
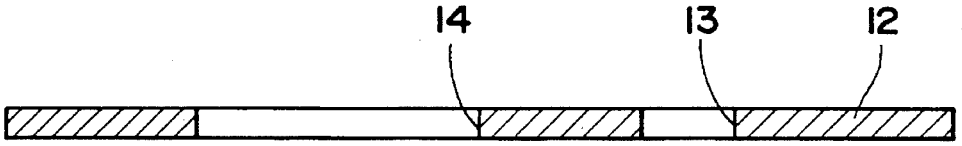
FIG. 7 is a sectional view of a liner shown in FIG. 6.

FIGS. 6 and 7 show a third embodiment of the present invention wherein, instead of forming a concave section on the metal frame, a liner 12 having a hole or a concave portion 13 is used so that the projection 6 may fit therein. Reference numeral 14 is a fitting hole in the lower or an upper nozzle. Thus, by so doing, the present invention can be applied to the existing device. Of course, the thickness of the structure in the face pressure direction changes so that it becomes necessary to adjust the shrinkage of the coil spring or the thickness of the plate-like refractory material. In these figures, like parts are designated by like reference numerals.

It should be noted that the liner 12 may be mounted in or dismounted from the metal frame 11 with ease in such a manner that the liner 12 is provided with a concave portion in the longitudinal side portion thereof or the nozzle fitting hole or with a slant hole in the planar portion thereof so that it may be mounted in or dismounted from the metal frame 11 by causing a hooking jig to engage the concave portion or hole. Alternatively, a magnet may be used for this purpose.

Thus, the present invention has the following effects:

(1) The mounting and dismounting of the sliding nozzle stationary plate or sliding plate in and from the metal frame can be performed in a simple manner during cold and hot condition.

(2) When a plate is manufactured by mounting a plate-like refractory material in a metal case, the manufacturing process is simplified.

What is claimed is:

1. In a structure comprising a sliding nozzle plate attached to a molten metal vessel and a metal frame to which the sliding nozzle plate is attached, and wherein said sliding nozzle plate is formed of a refractory material having a sliding surface, a non-sliding surface opposite to the sliding surface, and side surfaces, and is surrounded by a metal case with the exception of the sliding surface, and at least a molten metal passage hole extending vertically through the plate, said metal case surrounding said plate being provided with a projection or a plurality of projections on the non-sliding surface of said plate and said metal frame is provided with a plurality of concave portions corresponding to said projection or projections, respectively, so that each of said projections fits in each of said concave portions leaving a clearance in the range of between 0.1 and 1.0 mm in the sliding direction of said plate.

2. A structure according to claim 1, wherein each of said metal case projection or projections has a cylindrical portion having a diameter of less than one-third of the width of the plate, and a height in the range of between 1 and 5 mm, and a portion continuous with said cylindrical portion.

3. A structure according to claims 1 or 2, wherein each of said metal case projection or projections includes a portion in the shape of a bugle with a return section which is continuous with said cylindrical portion so as to form a gently curved surface smoothly approaching a horizontal bottom surface of said metal case, with the height of said return section being identical to the thickness of a joint material to be filled between the refractory material and the metal case.

* * * * *